US009078529B2

(12) United States Patent
Ellsworth

(10) Patent No.: US 9,078,529 B2
(45) Date of Patent: Jul. 14, 2015

(54) COLLAPSIBLE CHILD SEAT

(76) Inventor: Evan Ellsworth, Moro, IL (US)

( * ) Notice: Subject to any disclaimer, the term of this patent is extended or adjusted under 35 U.S.C. 154(b) by 728 days.

(21) Appl. No.: 12/134,885

(22) Filed: Jun. 6, 2008

(65) Prior Publication Data

US 2009/0008971 A1 Jan. 8, 2009

Related U.S. Application Data

(60) Provisional application No. 60/948,396, filed on Jul. 6, 2007.

(51) Int. Cl.
*A47C 29/00* (2006.01)
*A47D 1/02* (2006.01)

(52) U.S. Cl.
CPC ..... *A47D 1/02* (2013.01)

(58) Field of Classification Search
CPC ..... A47D 1/02; A47D 1/008; A47C 4/283
USPC ..... 297/42–45, 5, 6, 184.1–184.15, 136; 280/87.051
See application file for complete search history.

(56) References Cited

U.S. PATENT DOCUMENTS 1,341,303 A * 5/1920 Eberle ..... 297/45
1,521,740 A * 1/1925 Wernli et al. ..... 4/484
1,675,375 A * 7/1928 Netschert ..... 280/7.1
1,952,872 A * 3/1934 Kersten ..... 297/174 R
2,140,685 A * 12/1938 Baxter ..... 108/119
2,161,658 A * 6/1939 Hansburg ..... 297/125
2,450,301 A * 9/1948 Quiggle ..... 297/44
2,885,688 A * 5/1959 Dyrland ..... 4/476
3,034,153 A * 5/1962 Sargent ..... 5/98.1
3,105,665 A * 10/1963 Starkweather ..... 248/101
3,145,048 A * 8/1964 Dowdy et al. ..... 297/5
3,839,754 A * 10/1974 Hooper ..... 5/98.2
4,296,693 A * 10/1981 Archer ..... 108/28
4,544,203 A * 10/1985 Younger et al. ..... 297/391
4,796,314 A * 1/1989 Garduno ..... 5/98.2
4,799,700 A * 1/1989 Knoedler et al. ..... 280/87.051
5,050,862 A * 9/1991 Saghafi ..... 482/68
5,269,587 A * 12/1993 Cunningham et al. ..... 297/42
5,340,193 A * 8/1994 Wolf ..... 297/232
5,388,852 A * 2/1995 Bigo et al. ..... 280/642
5,496,094 A * 3/1996 Schwartzkopf et al. ..... 297/45
5,586,344 A * 12/1996 Liang ..... 4/484
5,857,944 A * 1/1999 Cone et al. ..... 482/66
6,247,750 B1 * 6/2001 Tsai ..... 297/16.2
6,481,794 B1 11/2002 Kassai et al.

(Continued)

FOREIGN PATENT DOCUMENTS

JP 08-085418 4/1996
JP 2001-138786 5/2001
JP 14-301965 10/2002

OTHER PUBLICATIONS

International Preliminary Examination Report (IPER), Dec. 8, 2008, PCT/US2008/066115, Ellsworth, Evan.

*Primary Examiner* — Laurie Cranmer
(74) *Attorney, Agent, or Firm* — Polster Lieder Woodruff & Lucchesi, L.C.

(57) ABSTRACT

A collapsible child seat having a collapsible frame that moves between an expanded position and a collapsed position. A seat member moveably attaches to the frame, with a recessed support for receiving and supporting a child. A retractable canopy covers the seat member.

18 Claims, 6 Drawing Sheets

(56) References Cited

U.S. PATENT DOCUMENTS

| | | | | |
|---|---|---|---|---|
| 6,527,285 | B1 * | 3/2003 | Calandro, II | 280/87.051 |
| 6,644,731 | B2 * | 11/2003 | Tang | 297/16.2 |
| 6,886,195 | B2 * | 5/2005 | Rimbau Vidal | 5/98.3 |
| 6,889,393 | B1 * | 5/2005 | Rinaldo | 4/484 |
| 6,997,111 | B2 * | 2/2006 | Giegerich | 108/25 |
| 7,017,924 | B1 * | 3/2006 | Lambert | 280/87.051 |
| D531,825 | S * | 11/2006 | Jenkins et al. | D6/335 |
| 7,281,759 | B1 * | 10/2007 | Strong et al. | 297/45 |
| D570,971 | S * | 6/2008 | Woodin | D23/299 |
| D575,962 | S * | 9/2008 | Senko et al. | D6/381 |
| 7,422,276 | B2 * | 9/2008 | Flannery | 297/16.2 |
| 7,431,388 | B2 * | 10/2008 | Sharapov | 297/184.11 |
| 2003/0071493 | A1 * | 4/2003 | Miyagi | 297/16.2 |

* cited by examiner

COLLAPSIBLE CHILD SEAT

CROSS-REFERENCE TO RELATED APPLICATIONS

This application is related to U.S. Provisional Patent Application No. 60/948,396 filed Jul. 6, 2007 from which priority is claimed, and is hereby incorporated by reference.

STATEMENT REGARDING FEDERALLY SPONSORED RESEARCH

Not Applicable.

BACKGROUND OF THE INVENTION

The present invention generally relates to child seats and activity centers, and more particularly pertains to collapsible child seats for travel and portability.

Stationary child seats and activity centers, designed to safely amuse and contain pre-ambulatory infants, are a popular item in the juvenile furnishings market. Typically, these child seats use a cloth sling seat, with two leg openings, that allows an infant to stand. The seat is designed to support an infant in the upright position and is often rotatably supported relative to its base or main frame so that the seated infant can rotate relative to the base or floor. The base can be rounded to allow rocking. The seats usually include a waist height tray with toys built into the tray or detachably attached to the tray.

However, these seats are not portable because of their size and general bulkiness. Therefore, use of the product is often limited to the home. Yet, there are many applications outside of the home for these seats, such as trips to the grandparent's house, trips to the park, and many other events and activities.

Therefore, there is a need for a portable collapsible child seat that can be transported for use in multiple locations.

DESCRIPTION OF THE DRAWINGS

In the accompanying drawings which form part of the specification.

Corresponding reference numerals indicate corresponding parts throughout the several figures of the drawings.

DETAILED DESCRIPTION

Figure 1:
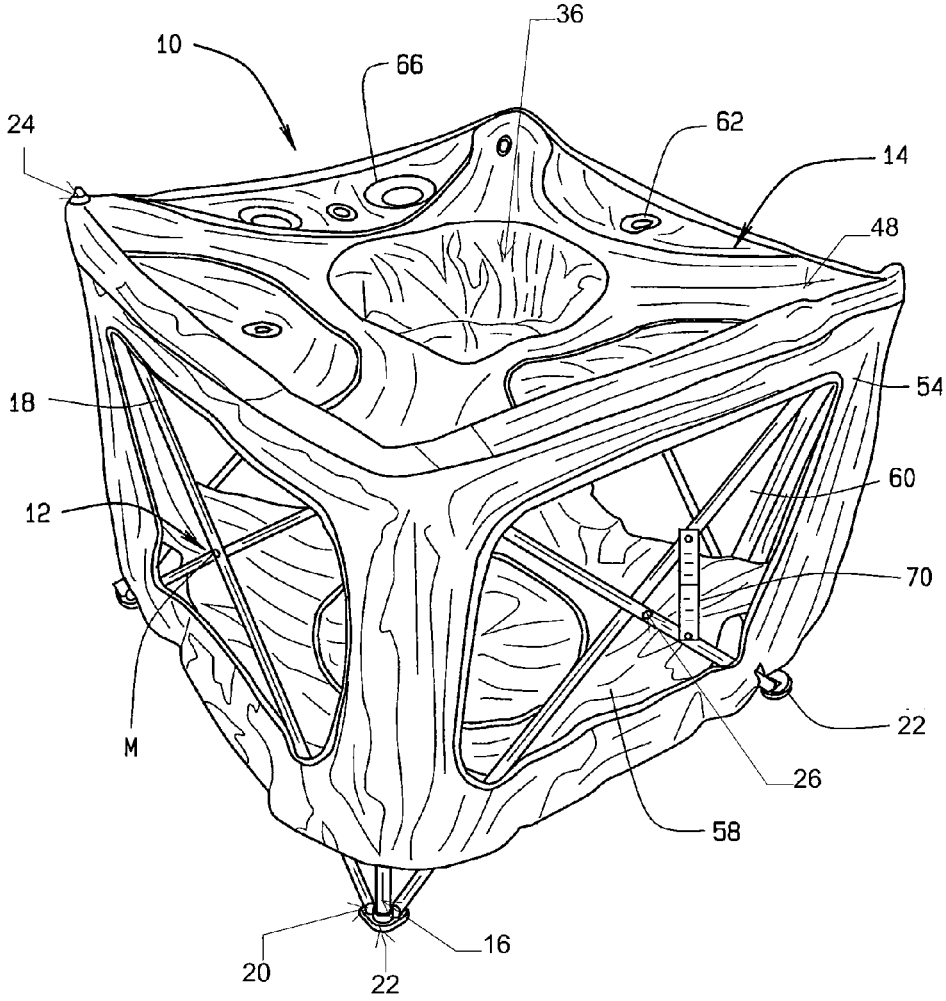
FIG. 1 is a rear perspective view of a collapsible child activity seat in an expanded position.
Figure 2:
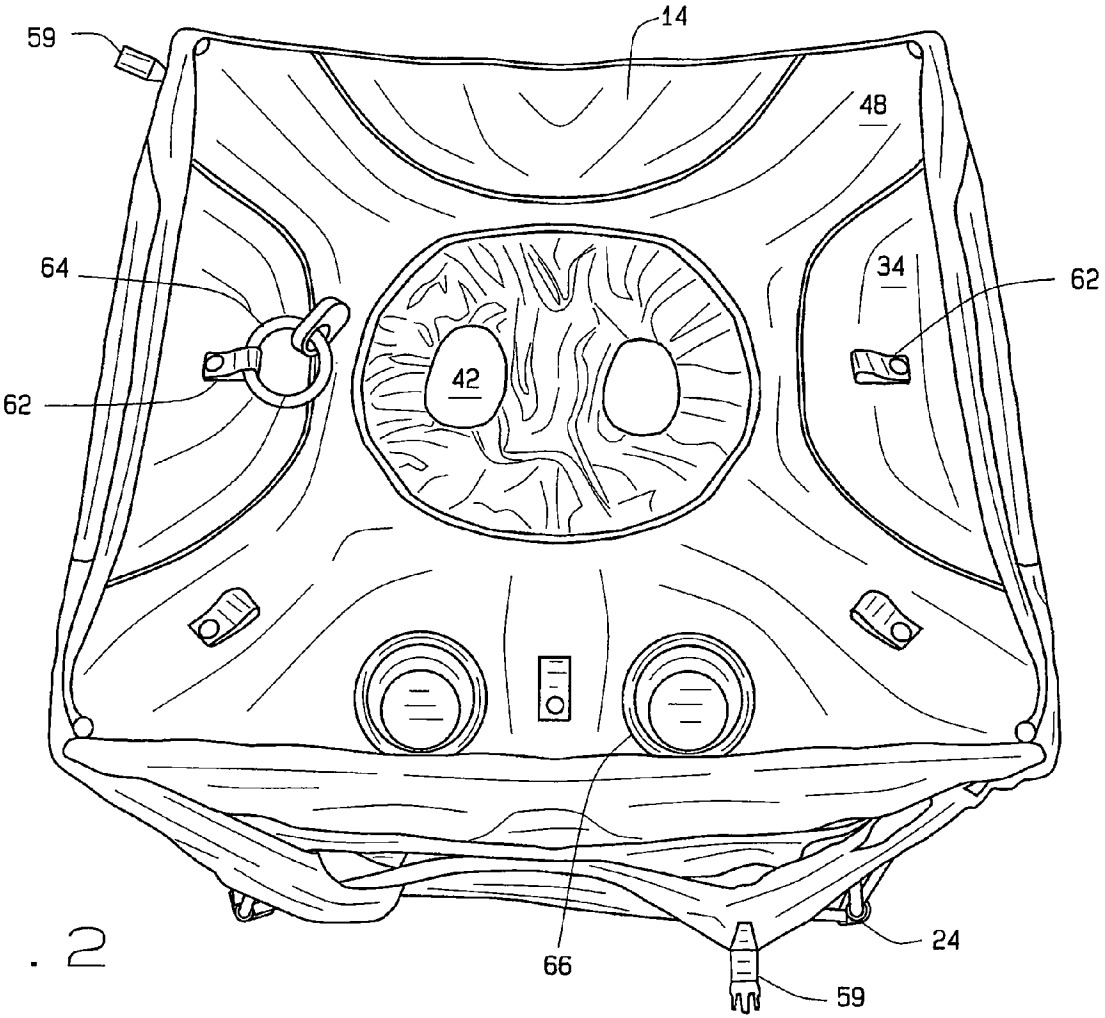
FIG. 2 is a top perspective view of the collapsible child activity seat in an expended position.

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention. Additionally, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

As shown in FIGS. 1-10, a first embodiment of the present invention, generally referred to as a collapsible child seat 10, includes a frame 12 that supports a seat member 14 for receiving a child. The seat 10 moves between a expanded position (FIG. 1) for receiving and supporting a child and a collapsed position (FIG. 5) for convenient storage and travel.

The frame 12 includes four (4) vertical posts 16 positioned at the corners of the frame 12, thereby, forming a generally rectangular shaped structure. A pair of braces 18 connect between respective posts 16 on each side of the frame 12. Each brace 18 pivotally attaches to the lower portion of a respective post 16, such as with a fastener 20 and a lower engagement member 22, and extends to pivotally attach to an upper portion of an adjacent post 16 with an upper engagement member 24. Each pair of braces 18 pivotally connect at their midsections (M), such as with a fastener 26, so that the braces 18 generally form an X-shape when the frame 12 is in an expanded position.

Figure 3:
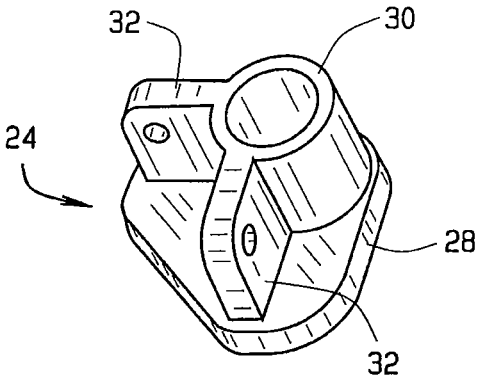
FIG. 3 is a perspective view of an engagement member.
Figure 4:
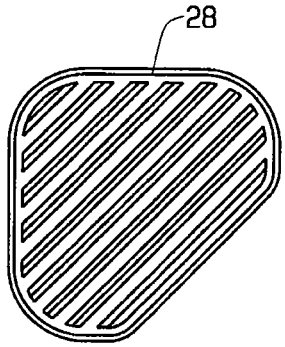
FIG. 4 is a bottom view of the engagement member.
Figure 5:
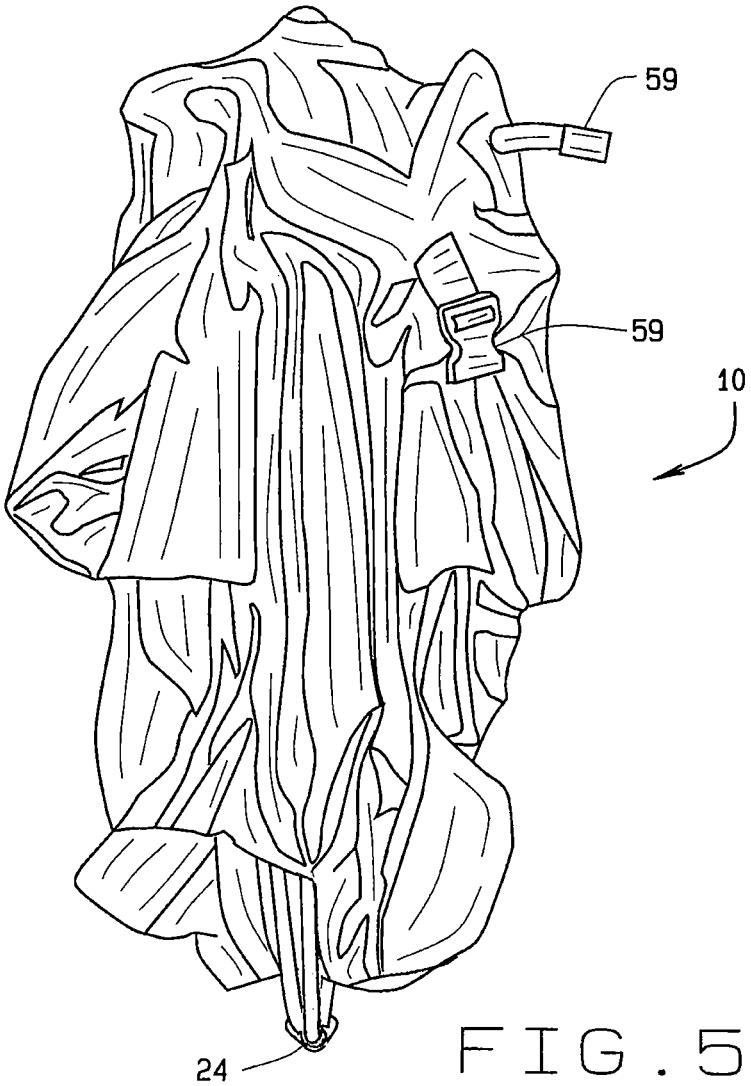
FIG. 5 is a front perspective view of the first embodiment in a collapsed position.

Both the upper and lower engagement members 24 include a foot 28 with a cylindrical holder 30 extending upwardly from the foot 28 and a pair of tabs 32 extending outwardly from the holder 30 at about a right angle from each other (FIGS. 3-4). Each post 16 inserts into the holder 30 and is secured preferably with a friction fit. The tabs 32 moveably engage each brace 18, such as with a rivet, so the frame 12 can move from the expanded position (FIG. 1) to a collapsed position (FIG. 5). In the collapsed position, the braces 18 pivot until they are generally parallel with the posts 16. Those skilled in the art will recognize that the frame 12 can comprise any number and any arrangement of posts 16 and braces 18 that can support the seat member 14 and a child.

Figure 6:
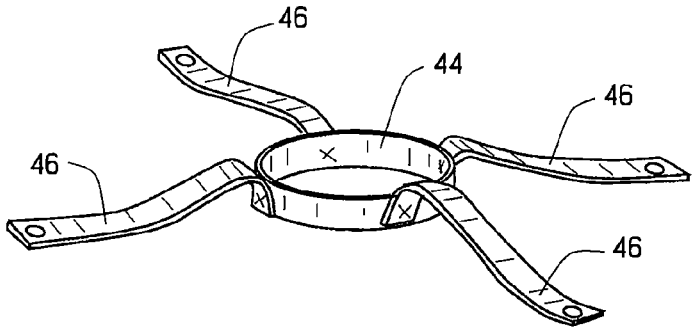
FIG. 6 is perspective view of a collar with extending straps.
Figure 7:
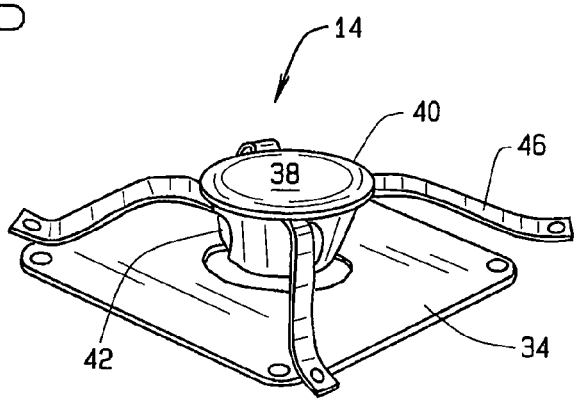
FIG. 7 is an exploded perspective view of a seat member.
Figure 8:
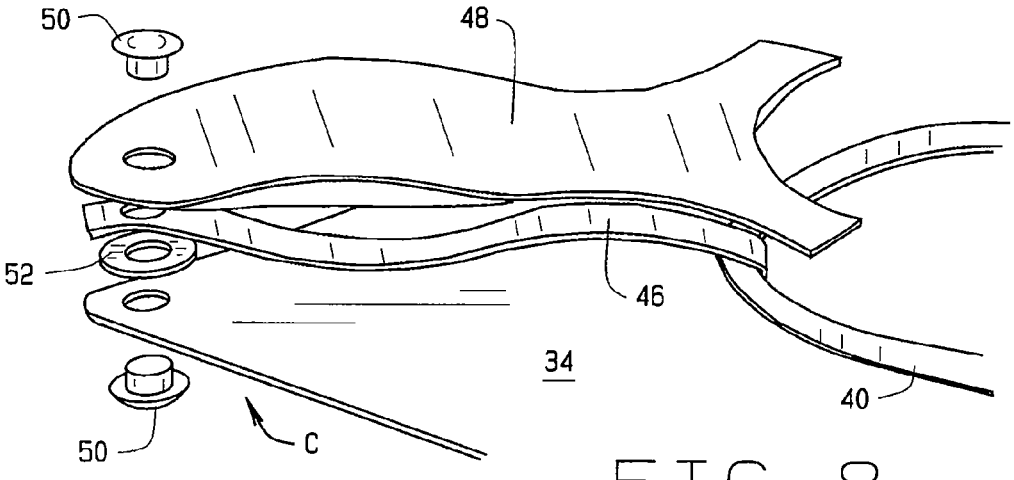
FIG. 8 is an enlarged exploded view of a corner of the seat member.

The seat member 14 is generally a rectangular panel 34 having a center opening 36 for attaching a recessed seating support 38, such as with stitching (FIGS. 6-8). The support 38 is generally catenary-shaped with a rim 40 and two leg holes 42 for receiving and supporting a child. For additional support, a collar 44 attaches to the underside of the rim 40, such as with stitching. Four straps 46, preferably made of nylon, extend outwardly from the collar 44 and attach to each corner (C) of the panel 34. A cover member 48 covers each strap 46 and attaches to the panel 34, such as with stitching, to prevent a children's hands from entanglement with the strap 46. As shown in FIG. 8, a pair of grommets 50 and washer 52 are used to attach the panel 34, strap 46, and cover member 48 to respective posts 16 at each corner (C) of the panel 34. However, other types of fasteners can be used. In the expanded position, each corner (C) of the seat member 14 rests on the upper engagement member 24. In alternate embodiments, the seat member 14 does not include the straps 46 and the collar 44. Rather, the support 38 attaches to the panel 34, such as with stitching, and the corners (C) of the panel 34 attach to respective posts 16 with fasteners.

Sidewalls 54 extend downwardly from each respective edge 56 of the of the seat member 14 and attach to a base 58, such as with stitching. (FIG. 1) Each sidewall 54 includes an opening 60 that allows visual and physical access to the inside of the frame 12. The base 58 acts as a barrier between the child in the seat 10 and the surface underneath. This allows the seat 10 to be used on multiple surfaces, such as grass, dirt, and mud. The panel 34, cover, 48, sidewalls 54, and base 58 are preferably a flexible material, preferably a weather resistant fabric. However, any suitable material can be used.

Attachment points 62, such as snaps, clasps, loops, hooks, hasps, Velcro® and the like, are located about the seat member 14 for attaching toys 64. Also, recessed cup openings 66 are positioned about the seat member 14 for receiving cups or other items. Those skilled in the art will recognize the seat member 14, sidewalls 54, and base 58 can be made of any suitable material, including, but not limited to cotton, polyester, natural materials, and man-made materials.

In operation, as the frame 12 moves from the expanded position to the collapsed position, the frame 12 contracts so that the collapsed seat 10 forms a generally cylindrical shape. The seat 10 is secured in the collapsed position with a suitable means, such as claps 59, straps, snaps, or Velcro®. In the expanded position, the seat is secured with a locking mechanism 70, such as clasps, attached between the braces 18. In addition, a second locking mechanism 72 can be used, such as the one depicted in FIG. 10. The locking mechanism 72 is a generally rectangular shaped bar with an L-shaped slot, which is pivotally attached between the braces 18. In the expanded position, a fastener 74 seats into the upper end of the slot to prevent the seat 10 from moving to the collapsed position. The user simply pivots the locking mechanism 72 to unseat the fastener and move the seat 10 to the collapsed position. Those skilled in the art will recognize that any suitable locking mechanism can be used.

Figure 9:
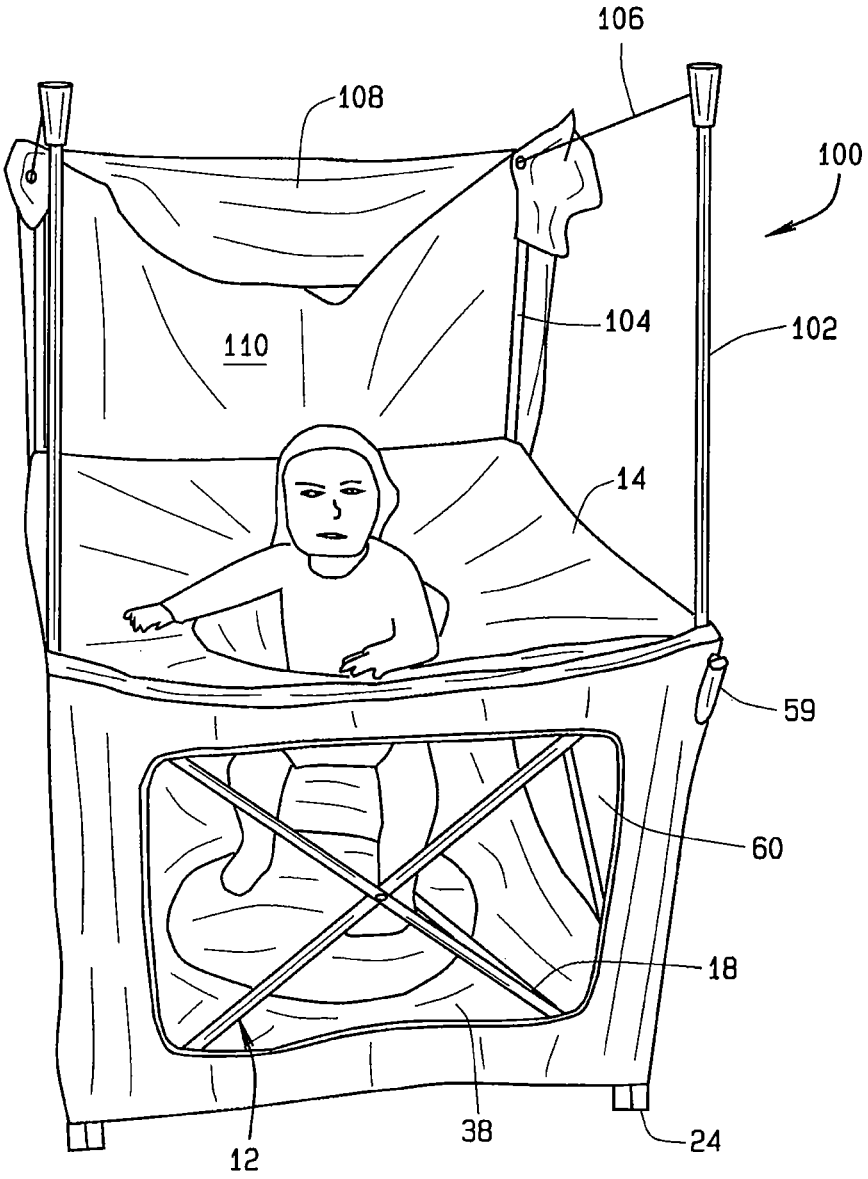
FIG. 9 is a perspective view of an alternate embodiment of a collapsible child activity seat with a canopy in an expanded position.
Figure 10:
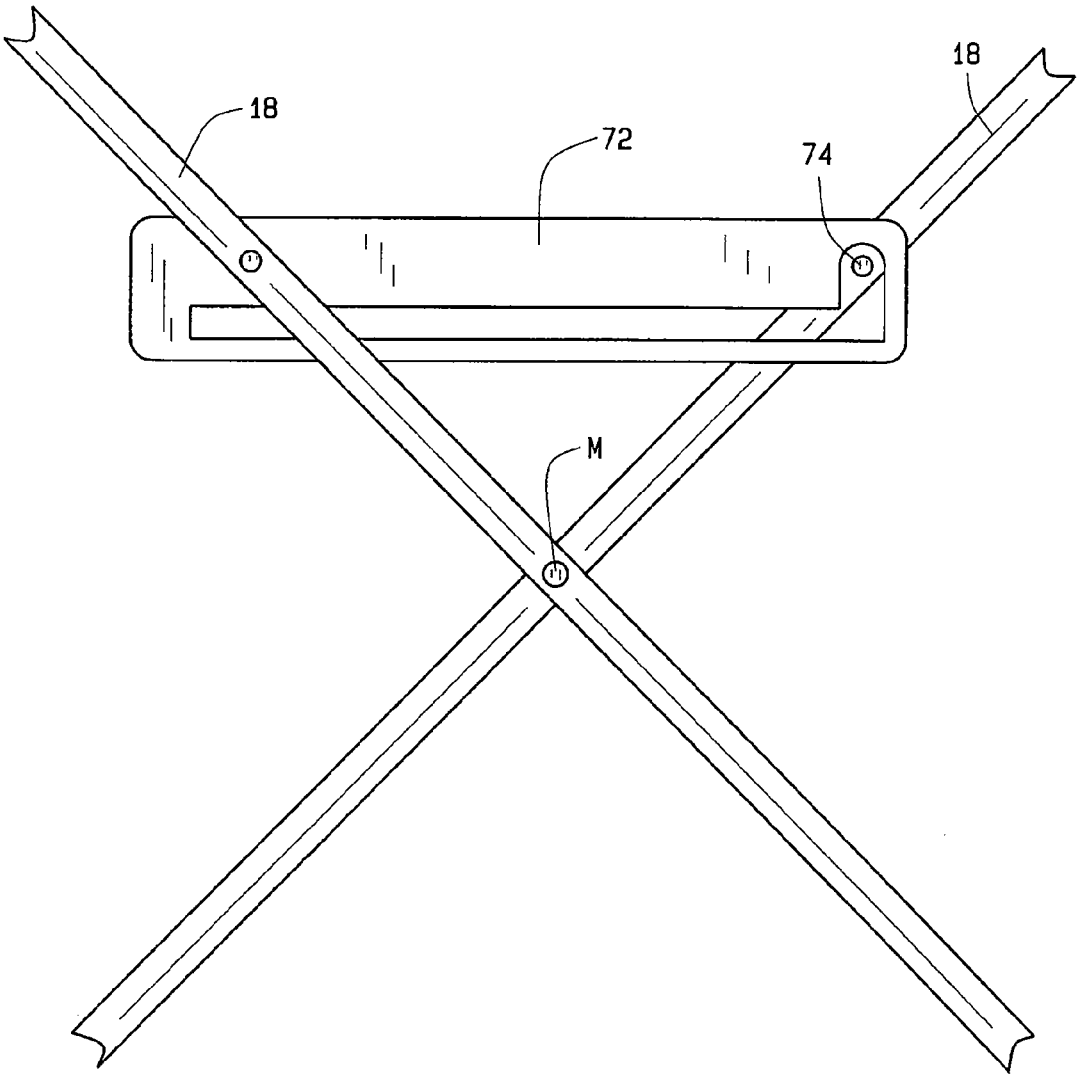
FIG. 10 is a rear view of a locking mechanism engaged with a frame.

As shown in FIG. 9, an alternate embodiment of the seat assembly 10 includes a retractable canopy 100 to provide shade over the seat member 14. In this embodiment, front posts 102 and rear posts 104 extend upwardly through the seat member 14 to locate the canopy 100 over the seat member 10. A pair of cables 106 extend from respective front posts 102 to rear posts 104 to moveably support an upper panel 108 of the canopy 100. This arrangement allows a user to move the upper panel 108 between an extended position (FIG. 10) and a retracted position (FIG. 9). In the extended position, the upper panel 108 can secure to the front posts 102 with a suitable means, such as magnets, snaps, Velcro®, and the like. Those skilled in the art will recognize that the canopy 100 can be supported by any number of different post arrangements. For example, the canopy 100 can be supported with only rear posts 104.

A rear panel 110 extends downwardly from the canopy upper panel 108 and attaches to the seat member 14, such as with stitching or Velcro®. The canopy upper panel 100 and rear panel 110 are preferably a flexible material, preferably a weather resistant fabric. Preferably, the upper panel 108 is positioned at an angle to prevent the collection of rain water or debris. However, the upper panel 108 can also be positioned to be level. In alternate embodiments, attachment points such as snaps, clasps, loops, hooks, hasps, Velcro®, and the like can be positioned about the underside of the upper panel 108 for attaching toys. Those skilled in the art will recognize the canopy can be made of any suitable material, including, but not limited to cotton, polyester, natural materials, and man-made materials.

Changes can be made in the above constructions without departing from the scope of the invention, it is intended that all matter contained in the above description or shown in the accompanying drawings shall be interpreted as illustrative and not in a limiting sense.

What is claimed is:

1. A collapsible child seat, comprising:

a collapsible frame configured for movement between an expanded position configured to receive and support a child and a collapsed position configured to store and transport the child seat;

a seat member moveably attached across an upper portion of the frame, the seat member having a generally planar and generally horizontal upper panel extending across a top of the frame, the upper panel defining an opening;

a recessed support attached to the upper panel at the opening and extending generally downwardly from the upper panel, the support being positioned generally below the upper panel, the support being sized and shaped to receive and support the child, and the support defining leg openings to receive the child's legs;

a base sized and shaped to cover at least a portion of the area below the seat member, the base being moveably connected to the collapsible frame for movement between the expanded position and the collapsed position, the base being configured to form a barrier between the seat member and a surface below the base when in the expanded position; and a side member extending between the seat member and the base.

2. The collapsible child seat of claim 1, the collapsible frame comprising:

at least three posts;

engagement members moveably attached to ends of the posts; and a pair of braces moveably connected to the engagement members and extending between two posts, the braces being pivotally connected at about their midpoint.

3. The collapsible child seat of claim 1, further comprising, attachment points on the seat member for securing toys.

4. The collapsible child seat of claim 1, further comprising at least one strap attached between the recessed support and the frame.

5. The collapsible child seat of claim 1, further comprising, a retractable canopy.

6. The collapsible child seat of claim 5, the retractable canopy comprising:

front and rear posts extending upwardly from the frame;

cables extending between the front posts and rear posts; and an upper panel moveably attached to the cables so that the upper panel moves between an extended position over the seat member and a retracted position.

7. The collapsible child seat of claim 5, the retractable canopy comprising:

posts extending upwardly from the frame; and an upper panel attached to the posts and positioned over the seat member.

8. The collapsible child seat of claim 1, further comprising, a locking mechanism attached to the collapsible frame that is capable of securing the frame in a collapsed position.

9. A child seat, comprising:

a collapsible frame configured for movement between an expanded position for receipt and support of a child and a collapsed position for storage and transport of the child seat;

a seat member moveably attached to the frame, the seat member having a generally planar and generally horizontal upper panel extending across a top of the frame, the upper panel defining an opening;

a recessed support attached to the upper panel at the opening, the support being positioned generally below the upper panel, the support being sized and shaped for receipt and support of the child, and the support defining leg openings for receipt of the child's legs;

at least three posts;

engagement members moveably attached to ends of the posts; and a pair of braces moveably connected to the engagement members and extending between two posts, the braces being pivotally connected at about their midpoint.

10. The collapsible child seat of claim 9, further comprising, attachment points on the seat member for securing toys.

11. The collapsible child seat of claim 9, further comprising at least one strap attached between the recessed support and the frame.

12. The collapsible child seat of claim 9, further comprising, a retractable canopy.

13. The collapsible child seat of claim 12, the retractable canopy comprising:

front and rear posts extending upwardly from the frame;

cables extending between the front posts and rear posts; and an upper panel moveably attached to the cables so that the upper panel moves between an extended position over the seat member and a retracted position.

14. The collapsible child seat of claim 12, the retractable canopy comprising:

posts extending upwardly from the frame; and an upper panel attached to the posts and positioned over the seat member.

15. The collapsible child seat of claim 9, further comprising, a locking mechanism attached to the collapsible frame that is capable of securing the frame in a collapsed position.

16. A collapsible child seat configured for movement between an expanded position for receiving and supporting a child and a collapsed position for storage and travel, comprising:

a plurality of posts;

a pair of braces pivotally connected at about their midpoints, the pair of braces moveably connected between two of the plurality of posts for movement between the expanded position with the pair of braces positioned in a generally X-shaped configuration and the collapsed position with the pair of braces positioned generally parallel with the plurality of posts;

a seat member moveably attached to an upper portion of the posts, the seat member having a generally planar and generally horizontal upper panel extending across the upper portion of the posts, the upper panel defining an opening;

a recessed support attached to the upper panel at the opening and extending generally downwardly from the upper panel, the support being positioned generally below the upper panel, the support being and sized and shaped to receive and support a child when the child seat is in the expanded position, and the support defining leg openings to receive the child's legs;

a base sized and shaped to cover at least a portion of the area below the seat member, the base being moveably connected to a lower portion of the collapsible frame for movement between the expanded position and the collapsed position, the base being configured to form a substantially continuous barrier between the child seated within the seat member and a surface below the base when in the expanded position; and a side member extending between the seat member and the base.

17. The collapsible child seat of claim 16, further comprising, a retractable canopy.

18. The collapsible child seat of claim 17, the retractable canopy comprising:

canopy posts extending upwardly from the plurality of posts; and an upper panel attached to the canopy posts and generally positioned over the seat member.

* * * * *